US005859619A

United States Patent [19]

Wu et al.

[11] Patent Number: 5,859,619

[45] Date of Patent: Jan. 12, 1999

[54] SMALL VOLUME DUAL OFFSET REFLECTOR ANTENNA

[75] Inventors: Te-Kao Wu, Rancho Palos Verdes; Benny Yee, Monterey Park; George H. Simkins, Torrance, all of Calif.

[73] Assignee: TRW Inc., Redondo Beach, Calif.

[21] Appl. No.: 735,285

[22] Filed: Oct. 22, 1996

[51] Int. Cl.[6] ..... H01Q 19/14

[52] U.S. Cl. ..... 343/781 CA; 343/781 P; 343/840

[58] Field of Search ..... 343/781 P, 781 CA, 343/781 R, 840, 839; H01Q 19/14

[56] References Cited

U.S. PATENT DOCUMENTS 3,852,765 12/1974 Bresler et al. ..... 343/781 R
4,232,322 11/1980 De Padova et al. ..... 343/781 R
4,356,494 10/1982 Katagi et al. ..... 343/781 CA

*Primary Examiner*—Hoanganh Le
*Attorney, Agent, or Firm*—Michael S. Yatsko; Ronald M. Goldman

[57] ABSTRACT

The problem of reducing the size of a dual offset Cassegrain reflector type microwave antenna without adversely affecting performance while retaining the simplicity of the main reflector's (1) and subreflector's (3) traditional simple surface curvatures is solved by having the paraboloidal shaped main reflector's focal length, fm, and diameter, D, fulfil the criteria that the ratio of fm to D is less than 1.0; and in which the hyperboloidal shaped subreflector (3) is oriented so that its left foci, at which the microwave feed (5) aperture is placed, lies above the main reflector's focal axis. It's subreflector subtends an angular arc about the focal point that is slightly larger than the corresponding arc subtended by the main reflector. The elegance of the compact antenna is demonstrated by improved performance, attaining efficiencies in excess of seventy three percent.

13 Claims, 3 Drawing Sheets

SMALL VOLUME DUAL OFFSET REFLECTOR ANTENNA

This invention was developed during the course of Contract or Subcontract No. F04701-92-C-0062 for the Department of Defense. The government has certain rights in this invention.

FIELD OF THE INVENTION

This invention relates to Cassegrain type directional antennas and, more particularly, to an improved more compact dual offset reflector antennas for satellite cross link communication systems. The new antenna is of smaller size than prior dual offset reflector antennas and exhibits a high electrical efficiency, all of which benefits the satellite environment.

BACKGROUND

Satellite to satellite microwave communication links commonly found in telecommunication and military space missile tracking application fulfil the need to electronically transfer or "hand off" data and/or other information between different geographic regions on earth being served by respective multiple satellites positioned hundreds of miles apart in geosynchronous orbit respectively covering those disparate regions or positioned in non-synchronous orbits that travel through a respective region.

To implement the communications link, the satellite contains appropriate microwave transmitters and receivers and an antenna that is highly directional in its RF radiation pattern, referred to as a cross-link antenna. The antenna is pointed at a like cross link antenna on another companion satellite in the link with which communication is to occur. Fed with microwave signals from the one satellite's microwave transmitter, the associated antenna, acting as a transmitting antenna, radiates the microwave energy furnished by the transmitter in the direction of the other satellite's antenna. The latter antenna, functioning as a receiving antenna, receives and couples the microwave signals to an associated microwave receiver on the companion satellite.

Concentrating the transmitted radiation in a specific direction to a known location offers the most efficient use of available transmitter power. Like concentration of received energy offers the most efficient reception by minimizing reception of out-of-direction unwanted signals originating elsewhere that might interfere with the desired communication, and, therefore, also minimizes transmitter power requirements.

One type of directional antenna achieving wide acceptance in the foregoing application and often found to be the antenna of choice is known as a dual offset Cassegrain antenna. That antenna comprises a parabolic reflector as a main reflector, a hyperbolic reflector as the subreflector and a microwave feed located at three spaced positions.

In a typical dual offset type Cassegrain antenna, the feed is positioned on the paraboloids focal axis spaced a distance from the hyperbolic reflector equal to the focal distance of the hyperbola's foci and the axis of the feed is tilted up. Both subreflector and feed are separately off-set in different amounts from the antenna's aperture that is defined by the main reflector.

In past circumstances where the size of the antenna is found to exceed the space available to store same on board the satellite, a typical approach was to include a hinged section in the antenna assembly. The hinge allowed the antenna to be folded down to fit within a smaller volume. When the satellite was positioned in space, the antenna was unfolded by means of a motor mechanism or robot arm to achieve its full size. Although such a foldable antenna satisfied existing requirements, not only does the incorporation of a hinge and related motors undesirably increase the weight of the assembly, the antenna elements may not precisely align to the desired relationship, resulting in poorer performance; and in some circumstances the mechanisms that were to unfold the antenna failed resulting in the failure of the entire mission.

Accordingly, an object of the invention is to provide a dual offset Cassegrain type antenna that is smaller in size than prior antennas of that type for the same transmitting frequency while delivering no less performance and, preferably, that delivers improved performance.

Another object of the invention is to provide an antenna for V-band operation that avoids the use of hinges and other implements characteristic of a foldable construction.

Still another object of the invention is to provide a low cost and light weight V-band cross link antenna system having a gain greater than 45 dB, a high efficiency, greater than 73%, and low side lobes.

SUMMARY OF THE INVENTION

In accordance with the foregoing objects a dual offset reflector antenna, containing a main reflector of paraboloidal shape, a subreflector of hyperboloidal shape, and a microwave feed, is constructed with a ratio between the main reflector's focal length and its diameter that is less than one; and with the subreflector oriented so that its left hand foci is located above the focal axis while its right hand foci is coincident in position with the focal point of the main reflector. The microwave feed's aperture is located at the subreflector's left foci and the feed's axis is oriented parallel to the focal axis and intercepts the subreflector. The foregoing relationship of the antenna elements departs from the traditional approach in a number of respects, particularly in including a focal length to diameter ratio of less than one.

As an additional aspect to the invention, the size of the subreflector is increased slightly from a size determined by traditional design concepts.

As a result, the antenna's size is reduced overall which benefits the satellite environment. As an extra benefit it is found that the antenna achieves a superior performance than the traditional dual offset reflector design.

The foregoing and additional objects and advantages of the invention together with the structure characteristic thereof, which was only briefly summarized in the foregoing passages, becomes more apparent to those skilled in the art upon reading the detailed description of a preferred embodiment, which follows in this specification, taken together with the illustration thereof presented in the accompanying drawings.

DETAILED DESCRIPTION OF THE PREFERRED EMBODIMENTS

Figure 1:
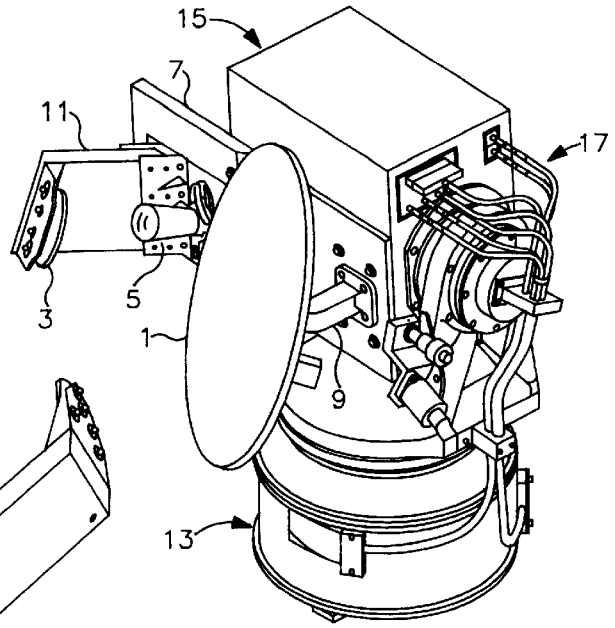
FIG. 1 is a perspective view of a gimbal mounted antenna assembly containing the antenna invention.

As shown in FIG. 1, a dual offset Cassegrain antenna intended for operation in the 50 to 65 Ghz frequency range, V-band, contains a parabolic shaped dish or reflector, which serves as the principal or main reflector, a hyperbolic shaped sub-reflector 3 and a microwave feed 5, all held together in a fixed spaced relationship. Reflector 1 is supported to a main antenna support panel 7 by an attached extending support arm 9. Subreflector 3 is also supported to the main support panel by support arm 11. That support arm extends outwardly from the main support panel and upwardly at an angle slightly greater than ninety degrees.

At one end microwave feed 5 contains the feed horn, the latter containing a port opening or aperture of circular geometry for propagating circular mode electromagnetic waves or, stated simply, circular waves. Such circular waves may be either or both right handed and/or left handed circular waves as selected by the system designer. As is the conventional practice, microwave feed 5 internally incorporates a waveguide transition and a polarizer, not separately illustrated, that transforms the waveguide mode RF that is inputted to the appropriate circular wave mode output from the feed horn; and vice-versa, where the antenna is used to receive V-band RF signals propagating from other transmitter systems. The structure of those internal elements are well known and need not be further described.

A metal electronics container or pack 15 contains the conventional microwave transmitters and serves as a convenient support for the antenna assembly, which is attached to a wall of the electronics pack by main antenna support panel 7. The electronics pack in turn is supported upon a gimbal 13.

The gimbal provides a electrically controlled motor driven rotatable support for the entire antenna and associated electronic assembly. It can turn the antenna about the gimbal's axis of rotation and position the antenna aperture at any angle, throughout a full 360 degree circle. As is the conventional practice, the gimbal is controlled remotely or by appropriate electronics that supplies the requisite power to the gimbals motors and ensures that the antenna is pointed in the desired direction.

Suitable cables 17 provide electrical connections to the ancillary support and control equipment, not illustrated. Since the latter equipment is known to those skilled in the art and its structure and operation is not material to an understanding of the present invention, that equipment need not be further illustrated or described.

Figure 2:
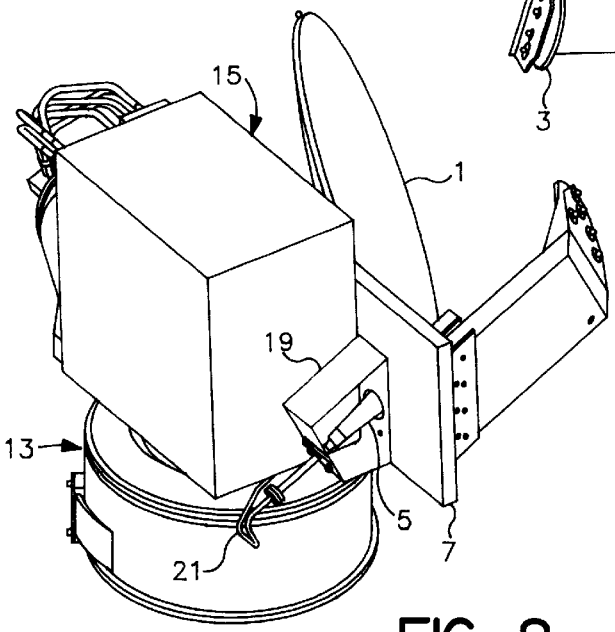
FIG. 2 is a view of the gimbal mounted antenna assembly of FIG. 1 rotated by one-hundred and eighty degrees.

As viewed from the rear in FIG. 2, the rear end of feed horn 5 extends through an opening in the rear of panel 7, where it is protected by an O-shaped bracket. A waveguide transmission line 21 extends from the input end of feed horn 5 into the electronics pack 15, where the line is connected to the output of the microwave transmitter.

Figure 3:
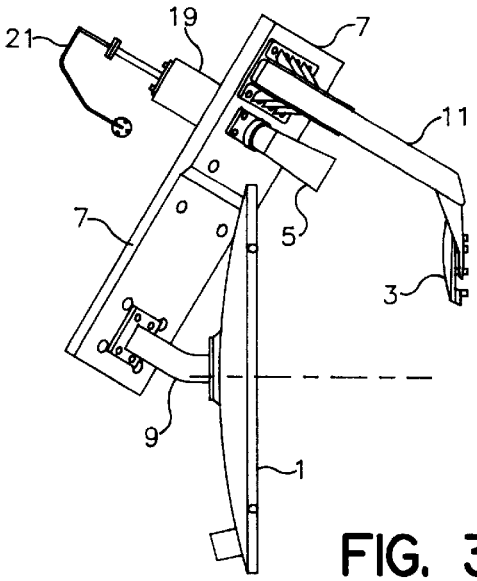
FIG. 3 is a side view of the novel antenna.
Figure 4:
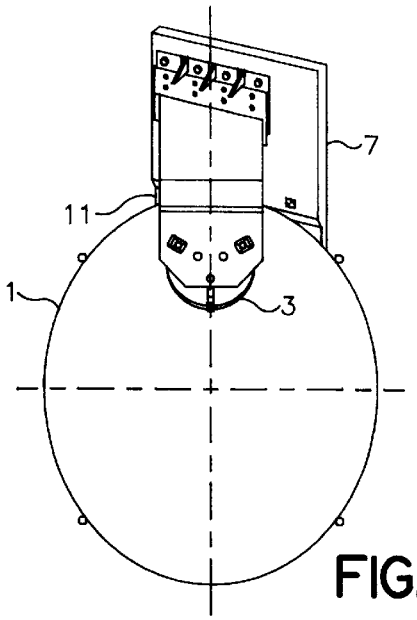
FIG. 4 is a view of the antenna of FIG. 3 as viewed from the right hand side.

Taken apart and separated from the electronics pack and gimbal, the novel antenna is viewed from a different angle in FIG. 3, to which reference is made. As shown in this figure, support arm 9 contains a bend that orients parabolic reflector 1 at an angle relative to support panel 7. As more clearly illustrated the axis of feed horn 5 is directed through or points at subreflector 3. FIG. 4, which is a view of FIG. 3 as taken from the right hand side, shows the center and aperture of the parabolic reflector 1 face on.

From viewing the preceeding illustrations, those skilled in the art immediately recognize the structure of a dual off-set Cassegrain antenna, but one in which some elements differ in position from that normally expected in a traditional design.

Figure 5:
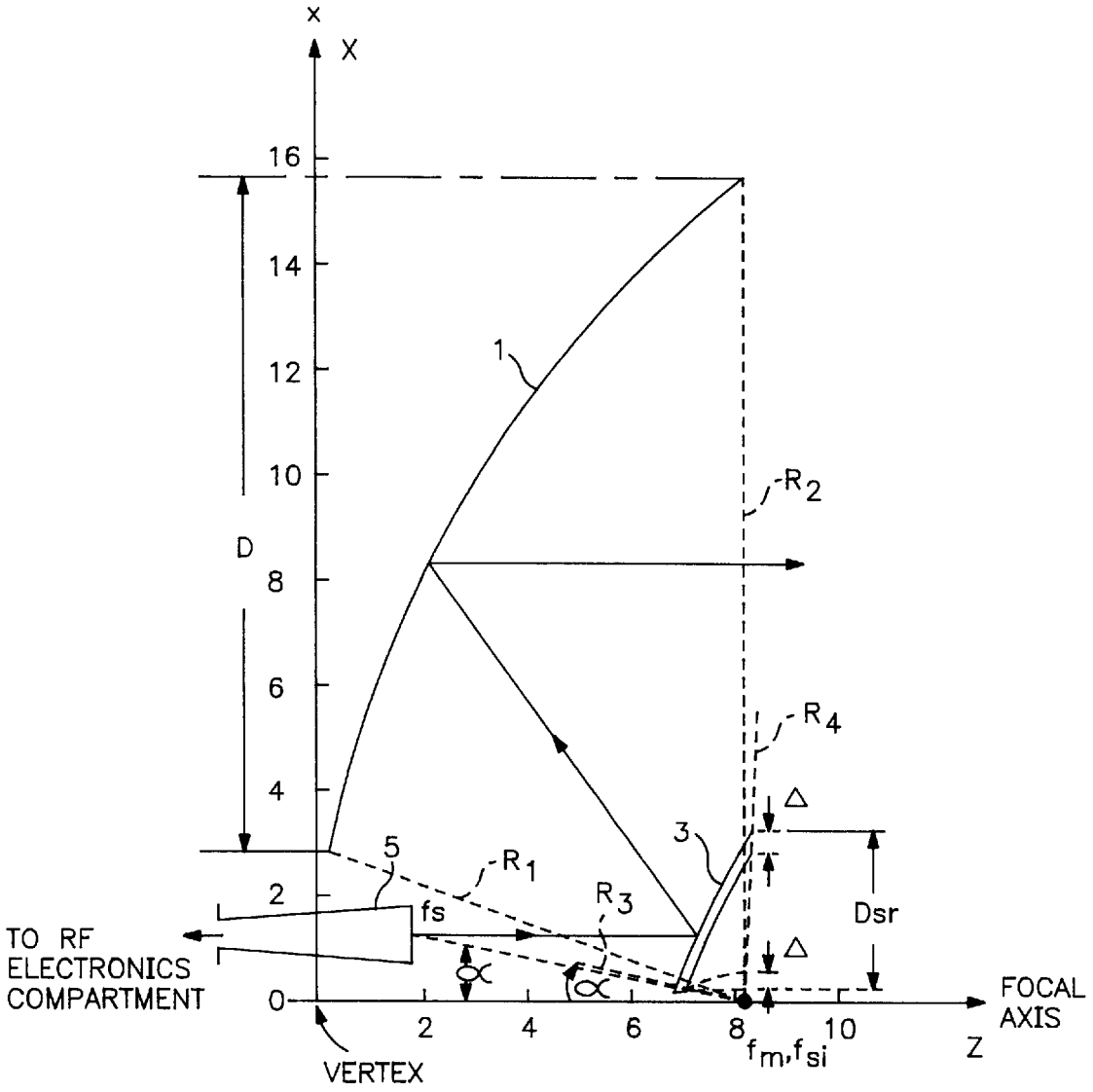
FIG. 5 is a side layout view showing the principal elements of the new antenna.

The geometrical relationship between the principal elements of the new antenna structure is better illustrated and understood from the partial side section or schematic view thereof presented in FIG. 5 to which reference is next made. In this figure, reflectors 1 and 3 are represented by the curved lines and feed 5 is illustrated in outline on the x–z axis coordinates of a Cartesian graph.

Reflector 1 is a segment of a paraboloid, a mathematically defined figure, and, in two dimension view, a parabola. That paraboloid contains a focal point, fm, and a central axis z, called the focal axis, with the distance along the focal axis between the focal point fm and the vertex, the bottom of the imaginary full size paraboloid, being the focal length, the latter of which may also be denominated as fm in the figure. Focal point fm lies on the focal axis, z.

Subreflector 3 is a segment of a hyperboloidal figure or, viewed in two dimension, a hyperbola, which is also a mathematically defined figure; and such hyperboloid defines two spaced focal points or foci, one to the right hand side, fs1, and one to the left hand side, fs. The equations describing those figures are available in the mathematical literature, and, except for the example given later in this specification, need not be repeated here.

It is realized that the two foci of the hyperbola also defines an axis that extends between those foci. To avoid confusion in this description, reference to focal axis is understood to mean the focal axis of the parabola or main reflector. That of the hyperbola is referred to more specifically as the hyperbola's or subreflector's axis.

Subreflector 3 is positioned so that its right foci, fs1, is coincident in position with the paraboloid's focal point, fm, in front of main reflector 1. Further, the subreflector is elevated slightly, as hereafter discussed in further detail, so that it and its left hand foci, fs, lies above the focal axis.

Feed 5 is also positioned above the focal axis a slight distance as is necessary to locate its port or aperture at the left loci, fs. The axis of feed 5, the principal axis of RF propagation, also extends parallel to the main reflector's focal axis, z, and intersects the subreflector. The subreflector's axis, between loci fs and fs1 defines a line that extends from the focal point upwardly to the left at an angle, $\alpha$, to the focal axis. The center of the feed 5's opening or aperture, as variously termed, is oriented on that subreflector's axis, at an angle, $\alpha$, above the focal axis, as viewed from the coincident focal point, fm, and loci fs.

The foregoing differs from the prior dual offset reflector antennas. As later herein illustrated in the next figure, the feed and subreflector in the prior dual offset reflector antennas are oriented so that the subreflector's left hand foci lies on the focal axis. And, as a consequence, the body or axis of the microwave feed 5 is tilted slightly up, placing the feed opening on the focal axis, so that its axis intersects the associated subreflector. And some portion of the associated subreflector surface extends down to and/or through the focal axis.

Two lines, R1 and R2, extend radially outwardly from the focal point to the respective bottom edge and upper edge of main reflector 1, and between them define an angle, β. That angle defines the arc length of subreflector 3 in conventional practice, wherein the subreflector extends over the same arc and is thereby congruent. A further criteria of importance to those charged with implementing a dual offset reflector antenna is the length of each reflector's projection taken on an axis that is perpendicular to the z-axis or focal axis, as variously termed, such as the x-axis illustrated in the figure. That projection is referred to as the reflector's diameter. The diameter of the main reflector's radiating aperature is indicated by the symbol D in FIG. 5 and the diameter of subreflector 3 as Dsr.

As an additional aspect of the invention or improvement, the size of hyperbolic subreflector 3 is in creased five per cent in the +x direction and ten percent in the −x direction from its nominal design dimension or, as alternatively stated, the lower end of the reflector extends down to the radial line R3 by an angular increment, Δ1β, of approximately ten percent of the angle β; and the upper end thereof extends up to radial line R4 by an angular increment, Δ2β, of approximately five percent of the angle β. Such enhanced length to the subreflector's surface and its increased diameter, Dsr, is found to minimize spillover loss and increase the antennas electrical efficiency.

As recognized by those skilled in the art, microwaves travel in a straight line and are reflected by conductive surfaces, following the behavior somewhat to that of light. That quality permits use of reflectors and other optics to achieve beneficial effects, which has been heretofore employed in certain antennas, one of which is the basic double reflector antenna or, as variously termed, Cassegrain antenna. The Cassegrain antenna uses reflectors to achieve high gain and eliminate backward radiation.

As is known, in that basic reflector antenna structure, a large paraboloidal reflector, the principal reflector, is illuminated with microwaves by a hyperbolic sub-reflector, whose convex surface faces the concave surface of the large reflector. In turn, the subreflector is illuminated with microwaves by a primary feed horn. The hyperbolically curved sub-reflector is symmetrically positioned so that its right hand foci is coincident in position with the focal point of the principal reflector. Both of the two foci of the hyperboloid lie on the focal axis, a line orthogonal to the surface of the paraboloid, represented by the z axis in the preceeding figure, that passes through the focal point. The output or aperture of the feed horn is located at the left hand foci of the subreflector. While performing well, the Cassegrain antenna occupies a considerable volume. Its aperture diameter, the length taken across a projection of the paraboloid on a plane tangent to the center of the parabola, is quite large, and also represents the overall height of this antenna. Its width extends from the vertex or back of the paraboloid to the outer edge of the subreflector.

A dual offset reflector antenna, which the present invention improves upon, is a modification of the foregoing basic Cassegrain. That basic Cassegrain antenna is symbolically represented in FIG. 6, to which reference is now made, by parabolic main reflector 10, 12 and feed horn 14. For convenience in making comparison to the invention and observing the differences in structure and the achievement of smaller antenna size, the figure also includes an overlay of the invention as earlier illustrated in FIG. 5.

Figure 6:
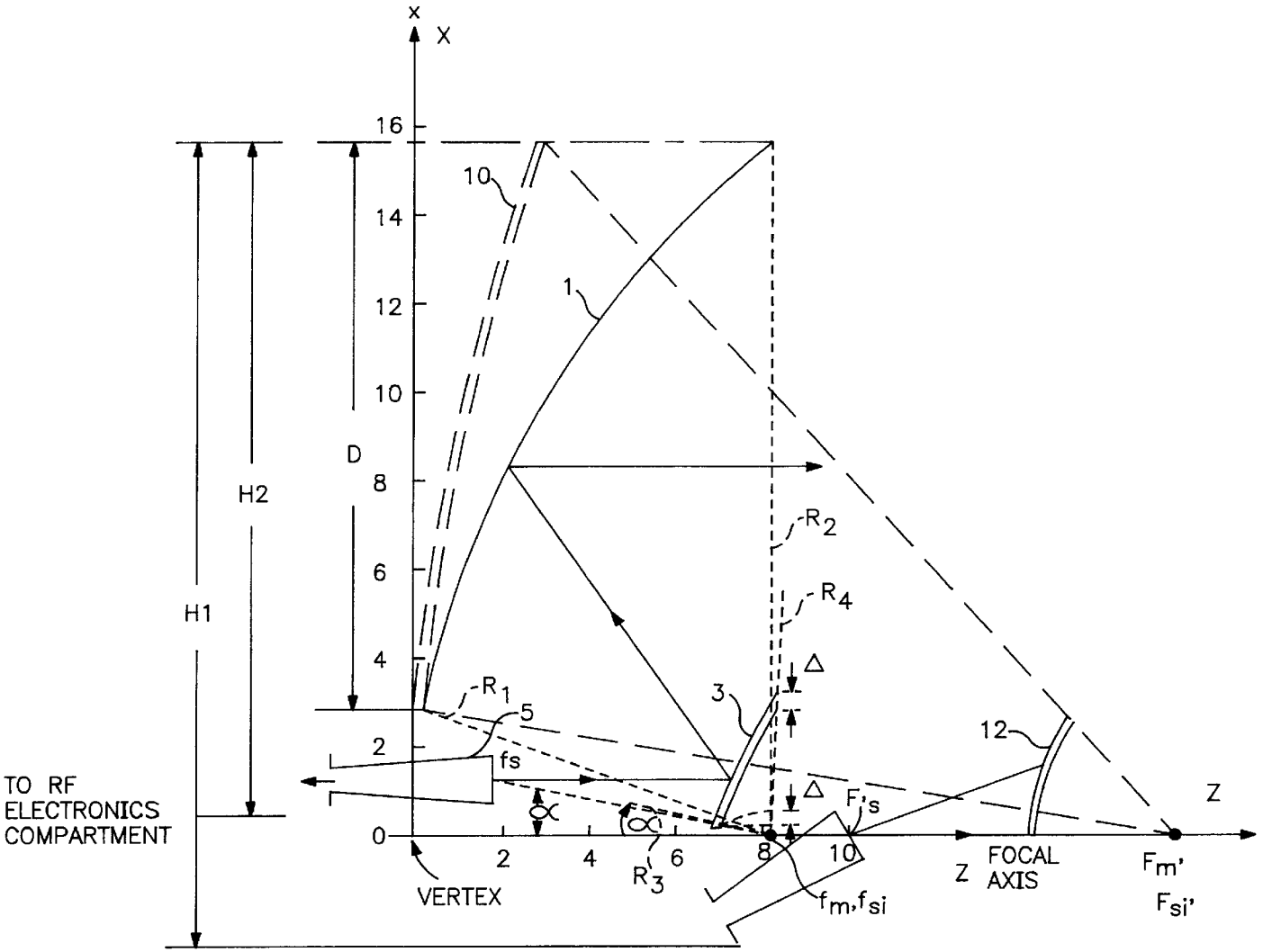
FIG. 6 illustrates a prior dual offset reflector antenna together with the new antenna for purposes of assisting in the discussion of the distinctiveness of the new antenna structure.

To reduce the size and yet retain a large portion of the benefit of the dual reflector antenna, the dual offset dual reflector antenna or modified Cassegrain, incorporates only a portion or segment of a full parabola, as represented by the principal reflector 10 in FIG. 6, and only a portion or segment of the hyperboloid surface, represented by subreflector 12. As shown, the antenna aperture, the diameter of the principal reflector 10, the projection of that reflector upon the x-axis, is smaller than that of a full paraboloid and the focal length of that main reflector is represented as fm'. In accordance with the conventional approach to the antenna's design, the ratio of the focal length to the diameter of the main reflector should be one or larger.

In such dual offset reflector antenna of the prior construction, the subreflector 12 is also positioned so that its right foci is coincident with the focal point and its left foci, fs', lies on the focal axis at the left foci, f'. And the feed horn aperture 14 is positioned on the focal axis, with the feed horn axis angularly rotated up, that is, tilted upwardly, to focus the high energy portion of the microwave energy emitted from the horn over the reflective surface of the hyperbolic segment of subreflector 12. With that construction, both subreflector 12 and feed horn 5 are offset in separate amounts from the principal radiating axis of main reflector 10, hence, the reference to dual offset.

As compared with the elemental Cassegrain antenna, the prior dual offset antenna, represented by elements 10, 12 and 14 in FIG. 6, achieves a smaller overall size. The aperture diameter of the paraboloidal main reflector is much less than the corresponding element in the basic antenna, and the overall height of the arrangement is principally the distance between the outer edge of the principal reflector 10 and the bottom edge of the feed horn 14, a distance represented as H1 in the figure.

Referring to the overlay of the invention in this FIG. 6, the present invention provides even greater compactness with the same antenna diameter or aperture, D. The paraboloidal shape of main reflector 1 is more condensed and defines a shorter focal length, fm, than the corresponding reflector 10 of the prior antenna. In the present invention, the ratio of the focal length of the main reflector to its diameter is less than one. This relationship is smaller than that prescribed in the traditional design specifications found in the technical literature.

With the hyperbolic shaped subreflector 3 positioned so that its right hand foci is coincident with the focal point, fm, of principal reflector 1. This positioning is referred to by applicant's as a "shortened" focal length. The subreflector 3 is raised in position so that its center is located a small distance above the focal axis. More specifically, the position of the subreflector is rotated about its right hand foci, fs1, so that its left hand foci, fs, is in a position above the focal axis and lies along a line, centered at right hand foci, fs1, and the focal point, that angles upwardly at an angle, α, to the focal axis, z. In other words it is oriented with the left hand foci located above the focal axis.

Since the feed horn's output should be located at the left hand foci of subreflector 3, feed horn 5 is rotated upwardly in position a small amount above the focal axis and oriented so that its axis runs parallel to the focal axis. The feed horn is also located above the focal axis. The feed horn is oriented so that equal radiation intensities, typically referred to as the 10 dB points, are incident upon the upper and lower edges of the sub-reflector 3, thereby flooding the surface of the subreflector with maximum microwave power.

As a consequence of the feed horn's new position, the overall height of the antenna, represented by height H2 in FIG. 6 is shortened. In summary, both the height and the width of the new antenna structure, and therefor the volume that it occupies, is reduced in amount from that occupied by the dual offset reflector antennas constructed in accordance with the traditional concepts. In the practical embodiment described later herein a volume savings of fifteen percent was achieved.

In one practical embodiment of the invention for V-band, The subreflector 3 was selected and oriented so that it had a projected diameter, Dsr, of 3.3 inches. The projected aperture diameter, D, for the main reflector of 13 inches and a focal length, fm, of 8.2623 inches was selected. This yielded a ratio of focal length to diameter, fm/D, of 0.636, which is smaller than one, and smaller than any previous dual offset reflector design known to applicants. The main reflector was placed at an off-focal axis height of 2.889 inches. The hyperbolic sub-reflector had an eccentricity of 1.578 and mathematical constants of a=2.0592346, b=2.5143692 and c=3.25 inches, and a distance between fm and fs (−fmfs) equal to 6.5 inches. The equation characterizing the hyperbolic subreflector in this example is $$\frac{(z-5.0122795)^2}{(a)^2}-\frac{(x)^2+(y)^2}{(b)^2}=1$$

The feed horn's aperture and the subreflector's left foci are located at an angle, α, of 11.375 degrees to the focal axis as viewed from the right hand foci or focal point.

In the practical embodiment, the principal reflector subtended an angular arc, β, of sixty eight degrees; and the subreflector covered an arc of seventy seven degrees. Conventional practice dictates that the subreflector also subtend the same angular arc; be essentially congruent. In the practical embodiment, the length of the subreflector was increased by three degrees at the upper end and six degrees at the lower end to achieve the overall arc length to the subreflector surface of 3.3 inches. The foregoing equates to the five percent figure in the x-direction (vertical) and ten per cent increase in the -x-direction (vertical) at the lower end.

Were the subreflector to subtend the same arc, as is the conventional practice, lower electrical efficiency is anticipated, possibly as low as sixty percent. Greater increases in the subreflectors length impose a weight penalty. Increasing the upper end only creates a blockage problem as the upper end necessarily intrudes into the antenna's radiating aperture.

In tests of a practical embodiment of the new antenna attains an electrical efficiency in excess of seventy percent, typically achieving seventy three percent efficiency. The antenna yielded high performance, achieving a 44.9 dBic gain, 73% efficiency, with a 2 dB axial ratio or −23 dB cross-polarization, and less than −20 dB peak sidelobe level from 59 to 64 Ghz in frequency.

Typical antennas of the prior design in contrast obtain efficiencies of about sixty percent. In conventional dual off-set reflector antenna designs, the feed, subreflector and main reflector are customarily placed at the far-field region with respect to each other. That traditional design requirement results in the antennas focal length to projected aperture diameter ratio, fm/D, that is greater than one. The requirement is intended to ensure the best beam scanning performance with a defocused feed and to avoid near field interaction. Near field interaction reduces antenna gain (or efficiency), and also causes higher sidelobe and cross-polarization levels.

Higher than 65% efficiency is possible in such prior designs, but that requires additional design effort and resources to shape the main and subreflectors. Those skilled in the art recognize that the efficiency of those prior designs may be improved by departing from the parabolic shape and hyperbolic shape for the reflectors, and providing modified shapes defined by a trial and error process that increases the efficiency of the prior construction above sixty percent. However, in departing from the regularity of mathematically defined shapes to more complicated surfaces, the fabrication costs of the antenna significantly increase as a consequence. The invention avoids increase in manufacturing cost.

Returning to FIG. 1, as is typical of antennas used space application, the main reflector 1 is constructed upon a base of honeycomb material that is formed to shape and covered on the front and back surfaces with a very thin layer of graphite. The graphite is electrically conductive and highly reflective of microwave energy. The foregoing construction provides a very light weight structure with low inertia that allows the gimbal to rapidly orient the antenna in any direction. Subreflector 3 is formed of aluminum, and is machined to the desired hyperbolic shape. All of the panels and brackets are also formed of aluminum, which is electrically conductive, strong and relatively light in weight.

The regularity of the geometric shape of the reflectors is important in practical application. Parabolic and hyperbolic shaped surfaces can be accurately and easily manufactured. The transition from known mathematical equations characterizing such surfaces to manufacturing machinery is relatively easy. By retaining those simple shapes, the cost of manufacturing the reflectors is minimized. As one appreciates, a less regular surface creates complications to both design and manufacture and thereby raises costs. In as much as the present invention retains the simple shapes to the reflector surfaces, the cost of manufacture remains as low as possible, lending further attractiveness to its industrial application It is believed that the foregoing description of the preferred embodiments of the invention is sufficient in detail to enable one skilled in the art to make and use the invention. However, it is expressly understood that the detail of the elements presented for the foregoing purpose is not intended to limit the scope of the invention, in as much as equivalents to those elements and other modifications thereof, all of which come within the scope of the invention, will become apparent to those skilled in the art upon reading this specification. Thus the invention is to be broadly construed within the full scope of the appended claims.

What is claimed is:

1. A dual offset dual reflector antenna for a satellite-to-satellite communication system, said antenna comprising:

a main reflector having a paraboloidal shape, comprising a segment of a paraboloid and defining a paraboloid focal axis, a focal length and a focal point, comprising a terminus of said focal length, located on said paraboloid focal axis;

a subreflector having a hyperboloidal shape, comprising a segment of a hyperboloid and defining first and second foci to said hyperboloidal segment;

said sub-reflector being positioned with said first foci in coincident position with said focal point and said second foci being located at a predetermined position above said focal axis;

a microwave feed horn having an aperture and a feed axis;

said microwave feed horn aperture being positioned at said second foci and above said paraboloid focal axis with said feed horn axis being oriented parallel to said paraboloid focal axis and intersecting said subreflector; and said focal length bearing a ratio relationship to said diameter of said main reflector that is less than one.

2. The invention as defined in claim 1, wherein said main reflector subtends a predetermined arc about said focal point and wherein said subreflector subtends at least said same predetermined arc.

3. The invention as defined in claim 2, wherein said arc subtended by said subreflector comprises an arc approximately fifteen percent greater than said predetermined arc.

4. The invention as defined in claim 2, wherein said arc subtended by said subreflector is greater than said predetermined arc and at its upper end extends beyond said arc by an amount equal to five percent of said predetermined arc and at its lower end extends below said predetermined arc by an amount equal to ten percent of said predetermined arc.

5. The invention as defined in claim 2, wherein said predetermined arc is sixty-eight degrees.

6. The invention as defined in claim 2, wherein said predetermined arc is sixty-eight degrees; and wherein said arc subtended by said subreflector is seventy-seven degrees.

7. The invention as defined in claim 6, wherein said second foci of said subreflector is located at a first predetermined angle of elevation above said paraboloid focal axis, $\alpha$, as viewed from said first foci of said subreflector, of 11.375 degrees.

8. The invention as defined in claim 7, wherein said ratio of focal length to diameter is 0.636.

9. The invention as defined in claim 2, wherein said microwave feed means includes a port having a circular geometry for propagating circular polarized waves.

10. The invention as defined in claim 1, wherein said second foci of said subreflector is located at a first predetermined angle of elevation above said paraboloid focal axis, $\alpha$, as viewed from said first foci of said subreflector.

11. The invention as defined in claim 1, wherein said ratio relationship of said focal length to said diameter of said main reflector is 0.636.

12. A dual offset dual reflector antenna for a V-band satellite-to-satellite communication system, said antenna comprising:

a main reflector having a paraboloidal shape, comprising a segment of a paraboloid and defining a paraboloid focal axis, a focal length of 8.26 inches and a focal point located on said paraboloid focal axis;

said main reflector having a diameter of 13 inches and subtending an arc of 68 degrees;

a subreflector having a hyperboloidal shape, comprising a segment of a hyperboloid and defining first and second foci to said hyperboloidal segment;

said sub-reflector being positioned with said first foci in coincident position with said focal point and said second foci being located at a predetermined position above said paraboloid focal axis and having a diameter of 3.3 inches and subtending an arc of 77 degrees;

a microwave feed horn having an aperture and a feed axis;

said microwave feed horn aperture being positioned at said second foci and above said focal axis with said feed horn axis being oriented parallel to said paraboloid focal axis and intersecting said subreflector; and said focal length bearing a ratio relationship to said diameter of said main reflector of 0.636.

13. A dual offset dual reflector antenna for a satellite-to-satellite communications system, said antenna comprising:

a main reflector having a paraboloidal shape, comprising a segment of a paraboloid and defining a paraboloid focal axis, a focal length and a focal point located on said paraboloid focal axis;

said focal length bearing a ratio relationship to said diameter of said main reflector of less than one;

a subreflector having a hyperboloidal shape, comprising a segment of a hyperboloid and defining first and second foci to said hyperboloidal segment;

said sub-reflector being positioned with said first foci in coincident position with said focal point and said second foci being located at a predetermined position above said focal axis;

and a microwave feed having a feed aperture for directing microwave energy to said subreflector, said microwave feed aperture being positioned at said second foci and above said paraboloid focal axis, and said feed having an axis oriented parallel to said paraboloid focal axis and intersecting said subreflector.

* * * * *